US010893760B2

(12) United States Patent
Han

(10) Patent No.: US 10,893,760 B2
(45) Date of Patent: Jan. 19, 2021

(54) FRAME CONFIGURED TO EASILY REPLACE EXHIBIT

(71) Applicant: Kukil Han, Jeollabuk-do (KR)

(72) Inventor: Kukil Han, Jeollabuk-do (KR)

( * ) Notice: Subject to any disclaimer, the term of this patent is extended or adjusted under 35 U.S.C. 154(b) by 0 days.

(21) Appl. No.: 16/647,645

(22) PCT Filed: Sep. 29, 2018

(86) PCT No.: PCT/KR2018/011609

§ 371 (c)(1),
(2) Date: Mar. 16, 2020

(87) PCT Pub. No.: WO2019/066600

PCT Pub. Date: Apr. 4, 2019

(65) Prior Publication Data

US 2020/0275789 A1 Sep. 3, 2020

(30) Foreign Application Priority Data

Sep. 30, 2017 (KR) ..... 10-2017-0128454

(51) Int. Cl.
*A47G 1/06* (2006.01)
*G09F 3/20* (2006.01)

(52) U.S. Cl.
CPC ..... *A47G 1/0633* (2013.01); *G09F 3/204* (2013.01); *A47G 2001/0672* (2013.01)

(58) Field of Classification Search
CPC ..... A47G 1/0633; A47G 2001/0672; G09F 3/201
See application file for complete search history.

(56) References Cited

U.S. PATENT DOCUMENTS 6,052,933 A * 4/2000 Lytle ..... A47G 1/0633 248/683
2003/0200690 A1* 10/2003 Galloway ..... A47G 1/0616 40/779
2007/0256343 A1* 11/2007 Yoon ..... A47G 1/0638 40/779
2008/0283715 A1* 11/2008 Morrison ..... A47G 25/0607 248/467
2010/0096531 A1* 4/2010 Morrison ..... A47G 1/0633 248/467
2010/0186275 A1* 7/2010 Freiberg ..... A47G 1/0633 40/737

(Continued)

FOREIGN PATENT DOCUMENTS

KR 101560745 10/2015

*Primary Examiner* — Gary C Hoge
(74) *Attorney, Agent, or Firm* — IPLA P.A.; James E. Bame

(57) ABSTRACT

Provided is a frame configured to easily replace an exhibit in the case where an exhibition location for a print is a magnetic material, such as a metallic plate, a wall surface of a building composed of a magnetic board or sandwich panel. A wide and thin rubber magnet plate and another rubber magnet plate thicker than the thin rubber magnet plate are cut into predetermined shapes, and a freely bendable thin transparent film is attached to the surface of the thick rubber magnet opposite to the magnet with an adhesive in the state of covering the outer periphery of the magnet plate, so that a space is secured between the thin rubber magnet plate and the film.

4 Claims, 5 Drawing Sheets

(56) References Cited

U.S. PATENT DOCUMENTS

| | | | | |
|---|---|---|---|---|
| 2013/0061500 | A1* | 3/2013 | Bird | G09F 3/201 40/658 |
| 2014/0237874 | A1* | 8/2014 | Tanaka | A47G 1/06 40/760 |

* cited by examiner

FRAME CONFIGURED TO EASILY REPLACE EXHIBIT

BACKGROUND

The present invention relates to a frame that is configured using a rubber magnet plate or transparent film fabricated in the form of a sheet in order to easily replace an exhibit in the case where an exhibition location for a print represented by a photo, a picture, letters, and/or the like is a magnetic material, such as a metallic plate, e.g., a wall surface of a building composed of a magnetic board or sandwich panel.

Korean Patent Application Publication No. 10-2014-0149020 that is contrasted with the present invention discloses a frame in which a front transparent cover can be selectively opened and closed. However, this frame has problems in that a plate-shaped frame body is separately present and the front transparent cover needs to be fastened to the plate-shaped frame body by using a bolt and nut.

SUMMARY OF THE INVENTION

An object of the present invention is to provide a frame that, in the case where an exhibition location for an exhibit is a magnetic material such as a metallic plate, allows a photo and/or a print to be easily replaced and is selectively attached and detached easily.

The core of the technical solution of the present invention for achieving the above object starts from the destruction of the stereotype that a picture frame should have a separate frame.

Unlike the present invention, the inventions of a number of picture frames using rubber magnets have been used only for the purpose of forming picture frames with separate materials and attaching the frames or attaching pictures and prints.

Although there are many requirements that picture frames should have, there are four main points on which emphasis is placed in the present invention. Each method that meets these four requirements will lead to the completion of a "frame configured to easily replace an exhibit" through organic combination.

In view of the fact that the present invention is a combined invention, such as the 1875 case "Pencil with Eraser" of the US Office of Appeals Tribunal, which is different from a simple aggregation, the mistake of interpreting a partial solution as a similar patent individually should be avoided even when one partial solution of the requirements presented below is similar to another invention.

In the present invention, the four requirements that a frame should have are that first, the frame allows a photo and/or a print to be visible, second, the frame provides a space for inserting the photo and/or the print, third, the frame prevents the photo and/or the print from being separated by a weak external force, such as the flow of air, and fourth, the frame secures aesthetics and noticeability.

The solution for meeting the first requirement is a flexible, elastic, transparent or translucent (colored transparent) film, which is one of the components. The solution for meeting the second requirement is a space that is famed by the displacement difference between a thin rubber magnet plate and a thick rubber magnet in such a manner that the thin rubber magnet plate slightly thicker than the area of an exhibit and having a predetermined thickness is provided and surrounded by the rubber magnet thicker than the rubber magnet plate at the periphery thereof and the thick rubber magnet and the film are adhered to each other with an adhesive, which is the second component. The solution for meeting the third requirement is to secure the resistance against external force through a hook function by cutting the upper side of the rubber magnet plate and a corresponding rubber magnet bar in an inclined form in order to reinforce the magnetic force of the thick rubber magnet, which is the third component. The solution for meeting the fourth requirement starts with the problem in which there is no frame. The purpose of the present invention is a picture frame. However, a frame is not present unlike the conventional picture frames. Accordingly, printing having the purpose of making the product of the present invention like line a picture frame is performed on the film. This is the fourth component.

A "frame configured to easily replace an exhibit" is completed by the organic combination of the above-described four components.

As products that are commonly used to exhibit photos and prints, Sanda cases and acrylic and synthetic resin cases are used. These products have two disadvantages of being inconvenient to use. First, it is inconvenient to insert an exhibit into the narrow space of the fixed frame. In particular, when the gap of the case is narrower or the exhibit is thinner and wider, the inconvenience becomes even worse due to static electricity caused by the friction between the paper and the case. Second, when a foreign material enters the frame during use, it is inconvenient to clean the material. In particular, when moisture such as rain water enters the gap of the case, the moisture is not removed well due to surface tension. However, if a phenomenon occurs that adheres to the surface of the case, the case must be discarded. If an exhibit is forcibly posted in a watery state, there occurs a phenomenon in which the ink of a print may smear or in which the wet exhibit may dry and adhere to the surface of the case, and thus the case must be discarded.

In order to solve the above problems, there was invented a picture frame that enables an exhibit to be easily replaced using a rubber magnet plate, the advantages of which over other picture frames are as follows:

First, there is no need for a separate device for attachment. In the case of other inventions, the weight increases as the size of the frame increases, and thus there is almost no invention configured to attach a frame using a magnet. In contrast, in the case of the present invention, when the size of an exhibit increases, the rubber magnet plate becomes larger, so that as the size of the frame increases, attachment force also increases, with the result that the frame can be installed wherever a magnet is attached without requiring a separate device.

Second, the risk of damage is significantly low. The rubber magnet plate or film is made of a material that can be bent freely, so it is free from impact. This advantage is an important requirement for industrial availability.

Third, the thickness of the frame is thin. The overall thickness of the frame includes merely the thicknesses of the rubber magnet rod, the film, the adhesive, and the printed film or the printed adhesive tape.

DETAILED DESCRIPTION OF THE INVENTION

A frame configured to easily replace an exhibit according to the present invention will be described with reference to the accompanying drawings, as follows. The following description will be given on the assumption that the frame is viewed in the state of being rotated by 90 degrees in a clockwise direction.

Figure 1:
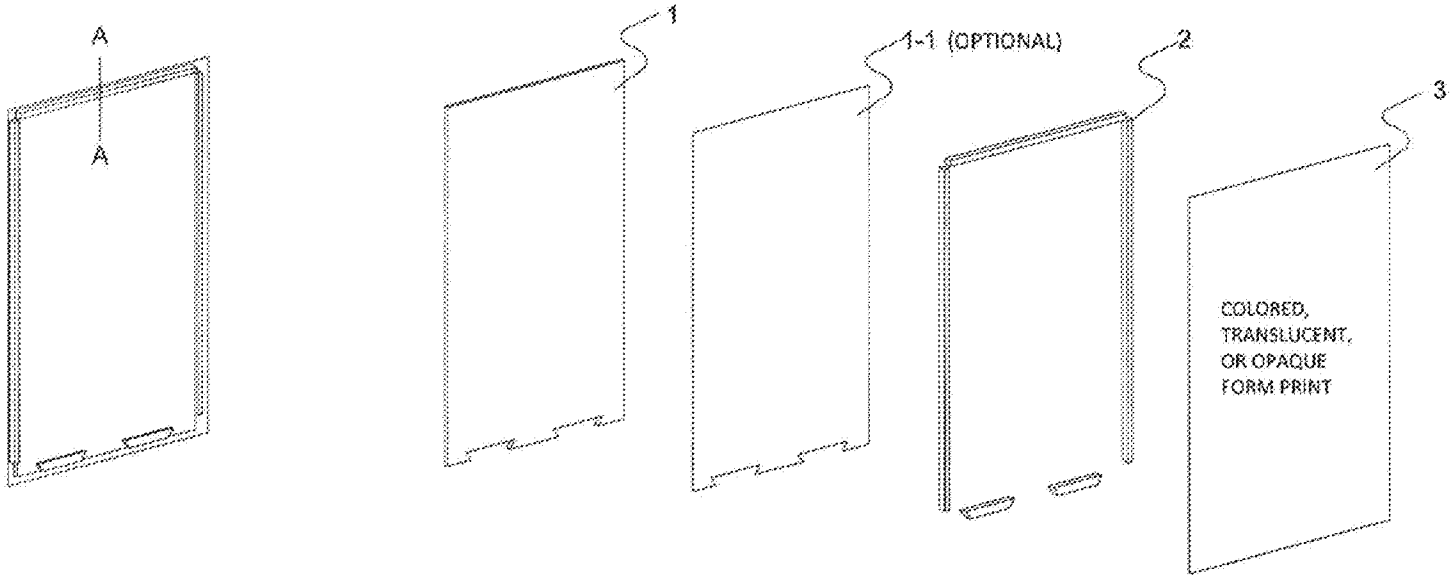
FIG. 1 shows a completely assembled view of a frame according to an embodiment of the present invention and exploded perspective views.

The leftmost view of FIG. 1 is a completely assembled view of a frame according to an embodiment of the present invention, and the right views are exploded perspective views.

The lower side of a wide and thin rubber magnetic plate 1 is cut out in the shape of a dovetail, a thick rubber magnet is cut into a predetermined shape, inserted into the dovetail groove of the thin rubber magnetic plate 1 and disposed in the state of covering the upper side and the left and right sides of the thin rubber magnet plate 1, and a freely bendable thin transparent film or thin transparent synthetic resin plate (hereinafter referred to as the "film") 3 and the surface of the thick rubber magnet 2 opposite to the magnet opposite to the rubber magnet plate are adhered to each other by using an adhesive. In this case, a space between the thin rubber magnetic plate 1 and the film 3 is secured by the difference in displacement between the thin rubber magnetic plate 1 and the thick rubber magnet 2, so that a frame configured to easily replace an exhibit, required by the present invention, can be constructed. In this case, the criteria for being thin and thick are based on comparison. That is, being thick means being thick compared to the other one, and being thin means being thin compared to the other one.

When an exhibit is thin and does not require a large displacement, rubber magnet plates of the same thickness may be used and a space may be secured by the thickness of the adhesive.

Figure 3:
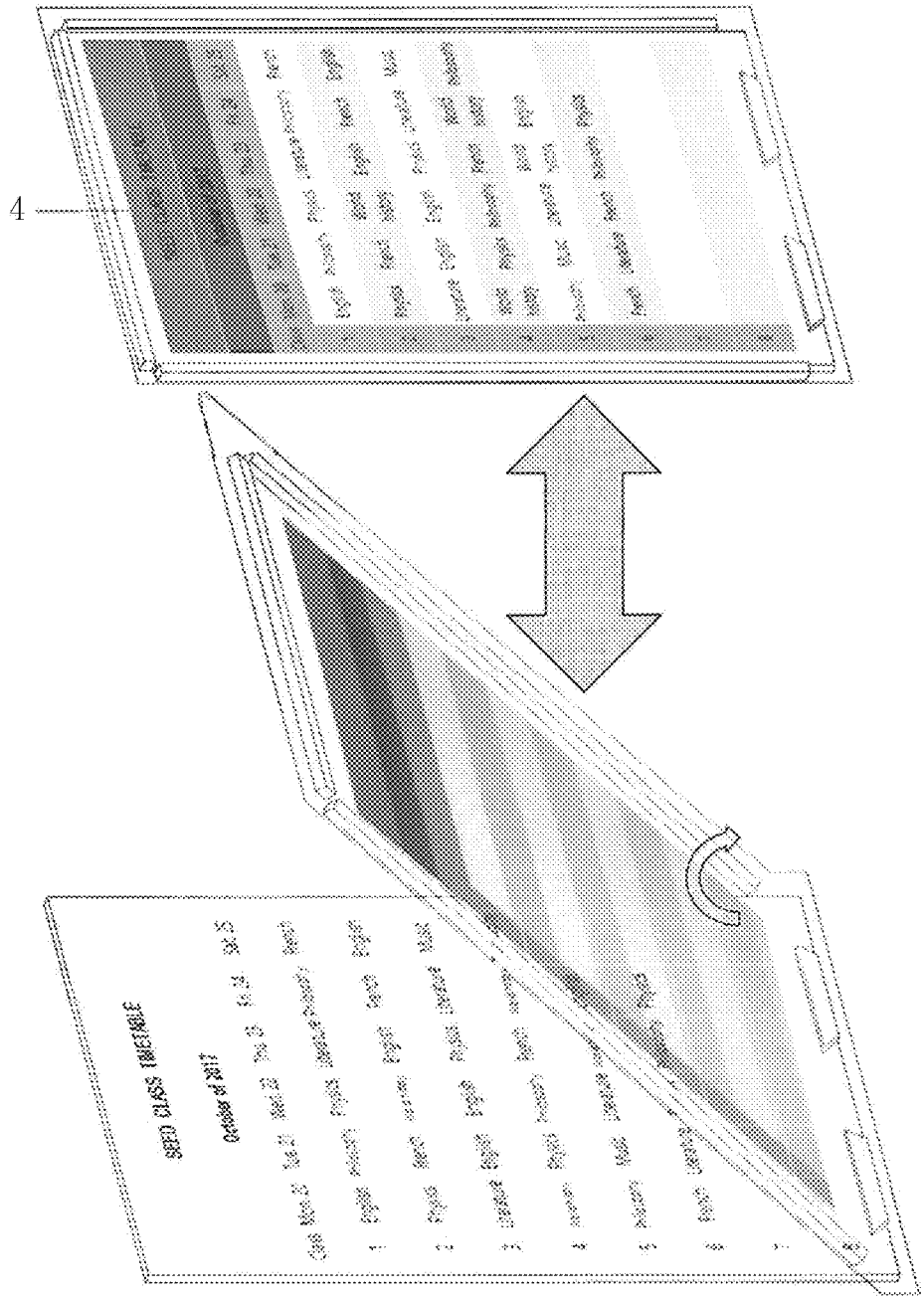
FIG. 3 shows perspective views illustrating an exhibit inserting operation according to an embodiment of the present invention.

The dovetail shape of the lower side is a requirement for the prevention of the twisting of the location where the that thick rubber magnet and the film are attached when the upper side and the left and right sides are separated from the magnetic material in order to insert an exhibit into the frame according to the present invention, as shown in the left view of FIG. 3.

The requirement of the adhesive for the thick rubber magnet 2 and the film 3 having a predetermined shape is that it needs to be made of a material that is excellent in adhesion force and offsets the difference in the expansion coefficient of each of the materials attributable to bending caused by detachment and attachment for the insertion of an exhibit. That is, the attached components are not separated from each other by shrinkage or extension.

Although an example that satisfies the requirement of the adhesive may be a synthetic rubber adhesive that is used as the adhesive of rubber, leather, etc., this is merely an example. The selection and development of a better adhesive are left to a manufacturer.

Figure 2:
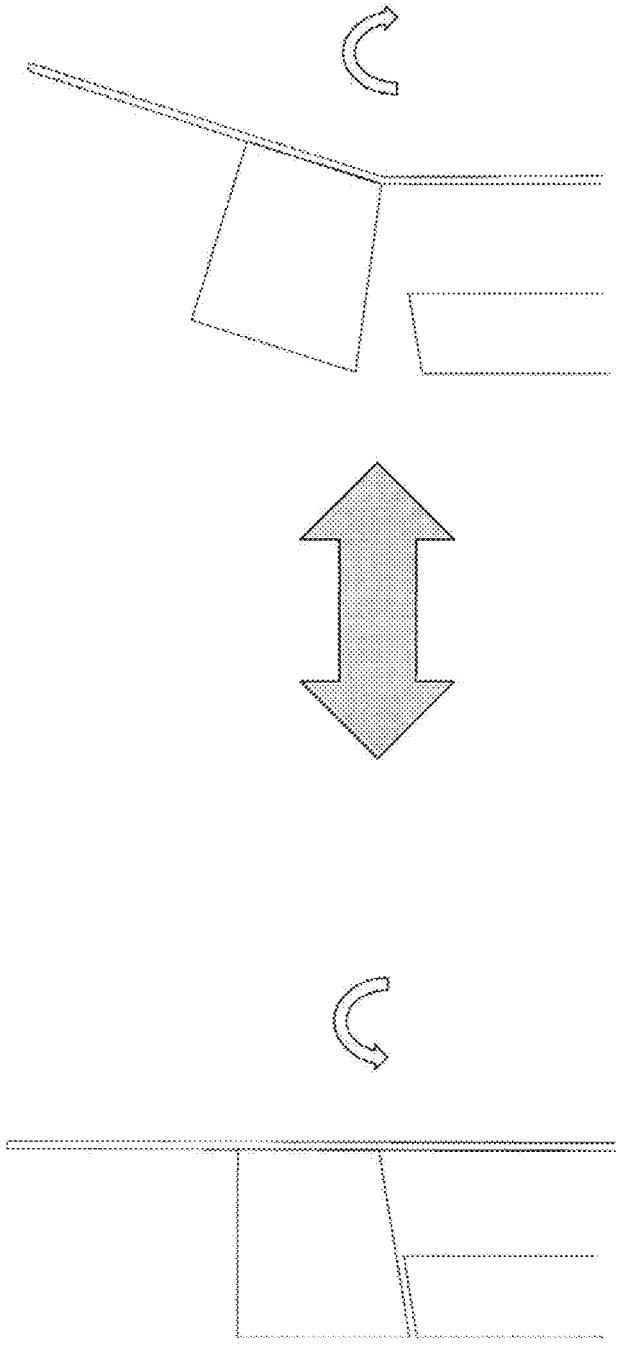
FIG. 2 shows detailed sectional views taken along line A-A of the completely assembled view of FIG. 1 and operational structure representations.

FIG. 2 shows detailed sectional views taken along line A-A of the completely assembled view of FIG. 1 and operational structure representations.

As the size of an exhibit increases, the size of the film increases and the weight thereof increases, so that the magnetic force of the thick rubber magnet 2 having a predetermined shape is insufficient to prevent the film from falling down from an attachment target surface. Of course, there is a method of increasing adhesive force by increasing the area in a predetermined shape. However, this is not reasonable, and causes a problem in that the size of the frame increases. However, the magnetic force imparted by the large area of the thin rubber magnet plate 1 may prevent the thin rubber magnet plate 1 and the thick rubber magnet 2 from falling down from the attachment target surface by supporting not only the thin rubber magnet plate 1 but also the thick rubber magnet 2 having the film attached to the dovetail shape and the upper side.

However, when external force such as a blow of wind, is applied to the film, the magnetic force of the thick rubber magnet 2 famed in a predetermined shape is insufficient to withstand detachment force acting in a vertical direction from an attachment surface. Accordingly, in order to reinforce adhesive force, the upper side or upper, left and right sides of the thin rubber magnetic plate 1 and the upper and lower sides or upper, lower, left and right sides of the thin rubber magnet plate 1 when the dovetail shape is removed are cut to be inclined in a direction in which the area of the rubber magnet surface is reduced compared to the opposite side of the rubber magnet surface, so that a hook function can be performed when the film and the predetermined thick rubber magnet 2 is attached to and detached from each other. Furthermore, the corresponding cut surface of the thick rubber magnet is cut to be inclined to face that of the thin rubber magnetic plate at the same angle. As a result, when detachment force is applied, the inclined surface of the thin rubber magnet plate 1 can support the inclined surface of the thick rubber magnet 2.

The thin hard synthetic resin plate or film 1-1 of FIG. 1 is attached to the thin rubber magnet plate 1 with an adhesive to thus reinforce resistance to bending, so that the corners of the thin rubber magnet plate are prevented from being worn due to the frequent detachment and attachment of the film and the thick rubber magnet 2 and support force is improved when separation force occurs.

FIG. 3 shows perspective views illustrating an exhibit inserting operation according to an embodiment of the present invention.

The dovetail shape of the thin rubber magnet plate 1 and the thick rubber magnet 2 allows an exhibit to be easily inserted when the thick rubber magnet plate 2 of the upper and left and right sides is separated from the magnetic body in the state of being attached to the magnetic body, and the dovetail shape of the thick rubber magnet plate 2 may prevent the film from falling down and function as a support when an exhibit is inserted.

In the case of black and white print exhibits, the production cost is low, but it is difficult to obtain aesthetics and noticeability. Accordingly, in the case of exhibits requiring aesthetics and noticeability, printing may be performed in color. In the case where the content of exhibits, such as announcements, price lists, class schedules, delivery cards, process shift tables, etc., is changed but the same form is continuously used, even when black and white prints are exhibited in such a manner as to print colored transparent or opaque forms on the film as shown in FIG. 3, the prints are overlaid on the content printed on the film, thereby ensuring aesthetics and noticeability.

Methods of performing printing on the film 3 include a method of directly performing printing on the film 3 and a method of attaching a separately printed film onto the film 3, adhered to the thick rubber magnet 2, by using an adhesive.

As part of a method of securing use noticeability in the frame of the present invention, such as a method of providing the look of a picture frame, there is a method of attaching a tape expressing a special texture (wood, marble, fabric, or the like) to the outside so that the portion where the thick rubber magnet and the film are adhered to each other can be covered, in addition to a method of using the printed film described above.

Figure 4:
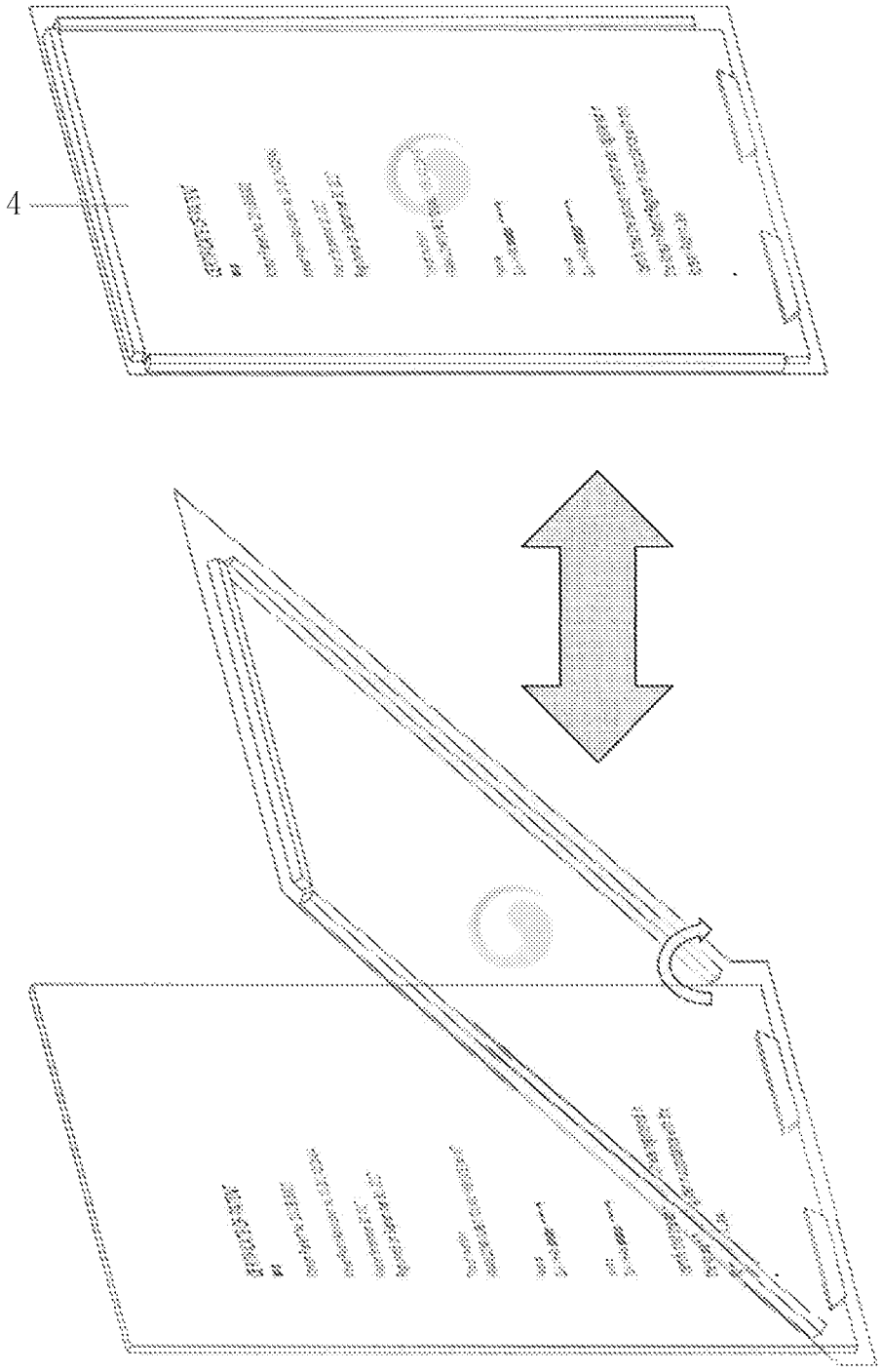
FIG. 4 shows perspective views illustrating an exhibit inserting operation according to an embodiment of the present invention.

FIG. 4 shows perspective views illustrating an exhibit inserting operation according to an embodiment of the present invention.

FIG. 4 is different from FIG. 3 in that a Korean Patent Office logo is printed lightly and transparently like a watermark instead of a specific form of print, so that it is possible to infer the agent of the management of a frame and an exhibit, thereby reducing the risk of loss.

Figure 5:
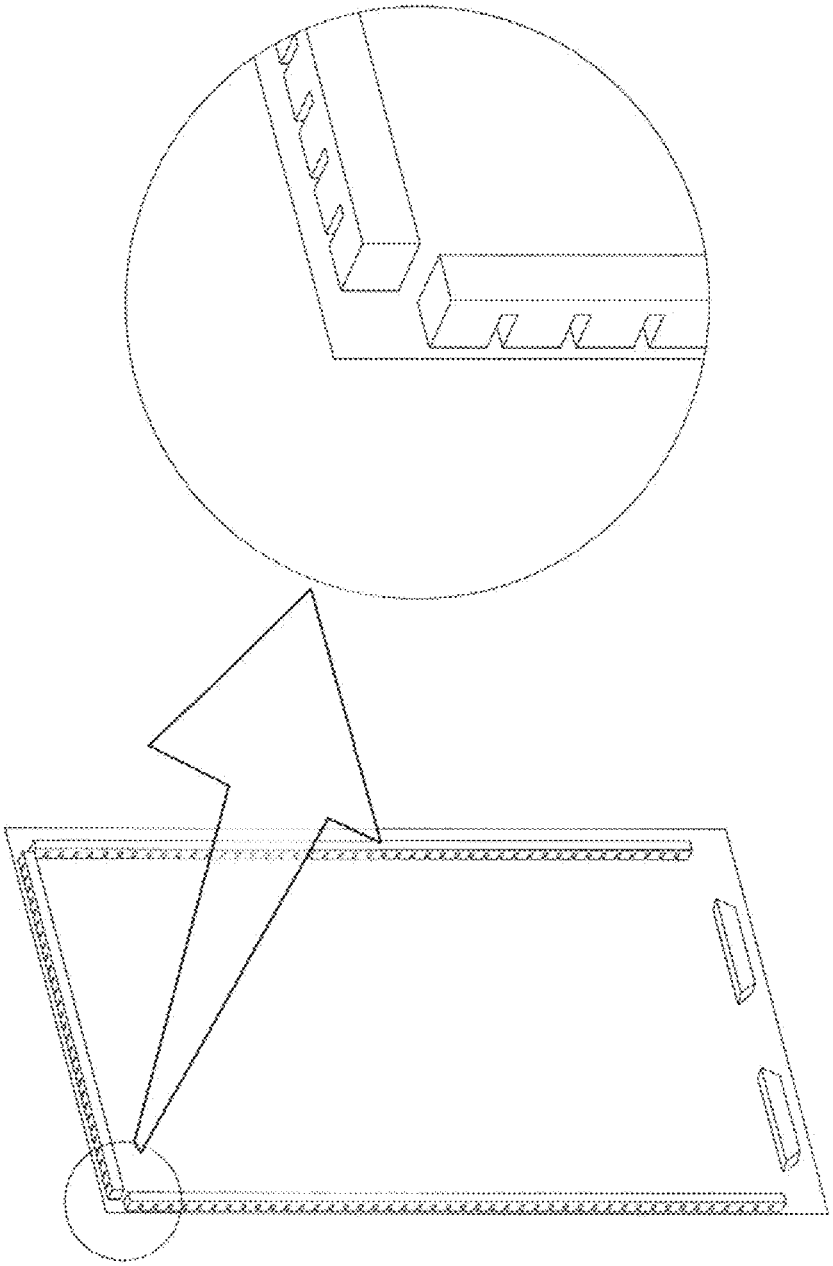
FIG. 5 shows a partially assembled perspective view and a detailed view in which a predetermined thick rubber magnet and a predetermined film are adhered to each other according to one embodiment of the present invention.

FIG. 5 shows a partially assembled perspective view and a detailed view in which a predetermined thick rubber magnet and a predetermined film are adhered to each other according to one embodiment of the present invention.

The part to be noted is a shape in which depressions of a certain depth are formed through the magnet surface of the predetermined thick rubber magnetic plate.

These depressions function to maximize the advantages of the rubber magnet plate.

An iron magnet requires a lot of power for attachment and detachment. The reason for this is that no bending occurs and thus the front of the magnet needs to be selectively attached and detached at the same time. However, the rubber magnet plate is bent freely, and thus it is selectively attached and detached easily from one side thereof. According to this principle, the attachment and detachment of the thin rubber magnet plate 1 having a large amount of adhesive force in a large area in the present invention do not require a large amount of force when bending is applied from a corner of the thin rubber magnet plate 1.

The depressions of a certain depth in the magnet surface of the rubber magnet plate make it easier to bend the rubber magnetic plate so that the rubber magnetic plate is smoothly separated when it is removed from the magnetic material and allows a frame to be attached to a structure such as a round pillar. The wider the depressions are, the more it is possible to attach the frame even to a pillar having a smaller radius of curvature.

The advantages that arise when the frame configured to easily replace an exhibit according to the present invention is used in industrial sites will be sequentially listed below:

First, there is less risk of damage attributable to impact. The component parts except for the adhesive of the frame are all freely bendable rubber magnet plate, film and thin synthetic resin, and these materials are difficult to be damaged by blow compared to other frame materials.

Second, it is easy to clean the frame. The film is selectively attached and detached easily. Accordingly, even when a foreign material enters an exhibition space, the frame can be cleaned and dried if moisture is infiltrated into the frame.

Third, aesthetics and clarity can be ensured economically. In the case where exhibits use the same form, when a colored, transparent or opaque print 4 is applied to the film, aesthetics and clarity are ensured at a low cost without the need for the color printing of the exhibits.

The above-described advantages are characteristics that can be beneficially used in industrial sites.

Most industrial sites, particularly the industrial sites of a manufacturing sector, are exposed to pollutant sources such as dust, and various types of labels need to be attached to steel pallets used to move products for each process.

For example, a "process management label" that records a work environment, and the amount of additive input and work results for each process and is attached to and moved on each pallet, a "delivery specification label" that records a part name, a part number, a lot No., quantity, etc., and an "unsuitability identification label" that records details of unsuitability based on test results, the number of parts, and the results of actions and is attached to and moved on each pallet, are moved along with the pallets, and need to be frequently detached and attached to record changes.

As a countermeasure against the above problem, methods of attaching a label to a pallet by using a magnet holder, a Sanda case, or a vinyl case are used, but each of the method has its disadvantage. In the case of the magnet holder, detachment and attachment are easily performed, but the magnet holder is open and has a disadvantage in that a label is contaminated. In the case of the Sanda case and the vinyl case, it is inconvenient to insert labels into the posting spaces thereof. Although labels are prevented from being contaminated, but the Sanda case and the vinyl case need to be replaced periodically because there is a problem with cleaning when dust or the like enters the insides thereof.

In addition, although the method of performing color printing on the film has been presented as a method for securing noticeability, as described above, continuous noticeability can be ensured by using a simple method of drawing an underline or a star on the film with a color oil magic or highlighter.

The invention claimed is:

1. A frame configured to easily replace an exhibit, wherein a wide, thin rubber magnet plate, a lower side of which is attached to a magnetic material, functions to support an overall load of the frame, and is cut in a dovetail shape, is provided, a thick rubber magnet is cut into a predetermined shape, inserted into a dovetail groove of the thin rubber magnet plate, and disposed to cover upper, left and right sides of the thin rubber magnet plate, a freely bendable thin transparent film or synthetic resin plate is adhered to a surface of the thick rubber magnet opposite to the magnet with an adhesive so that a space, into which an exhibit can be inserted, is ensured between the thin rubber magnet plate and the film by a difference in displacement between the thin rubber magnet plate and the thick rubber magnet, and a colored transparent or colored opaque print or a tape with a special texture (wood, marble, or fabric texture) is applied or adhered to a periphery of the film recognizable as a periphery of the frame in order to allow the frame to look similar to a conventional picture frame.

2. The frame of claim 1, wherein an upper side or upper, left and right sides of the thin rubber magnetic plate and upper and lower sides or upper, lower, left and right sides of the thin rubber magnet plate when the dovetail shape is removed are cut to be inclined in a direction in which an area of a rubber magnet surface is reduced so that the thin rubber magnet plate having strong magnetic force can be supported when detachment force is applied to the film and the thick rubber magnet by external force such as a blow of wind, a corresponding cut surface of the thick rubber magnet is cut to be inclined to face that of the thin rubber magnetic plate at a same angle so that a hook function can be performed when the film and the predetermined thick rubber magnet is attached to and detached from each other, and the thin hard synthetic resin plate or film is adhered to the thin rubber magnet plate with the adhesive so that corners thereof are prevented from being worn and required support force is secured when detachment force attributable to external force is applied.

3. The frame of claim 1, wherein a colored transparent or colored opaque form or a separately printed film is printed or adhered not only on an outside of the film but also on an overall surface of the film, so that a black and white print is overlaid on the film print content even when the black and white print is exhibited, thereby ensuring aesthetics and noticeability, or a company's logo or organization's name, other than a separate form, is lightly printed in a colored transparent form like a watermark or a separate printed film is adhered, so that it is made possible to infer an agent of management of the frame, thereby reducing a risk of loss.

4. The frame of claim 1, wherein depressions of a certain depth are formed through a magnetic surface of the thick rubber magnet to thus allow the thick rubber magnet to be bent more easily, so that the thick rubber magnet is smoothly removed when it is removed from the magnetic material and the frame is attached to a structure such as a round column.

* * * * *